United States Patent [19]

Norman et al.

[11] Patent Number: 4,953,870

[45] Date of Patent: Sep. 4, 1990

[54] TOSSABLE STRATEGY-TYPE GAME WITH TRI-DIMENSIONAL PLAYING SURFACE

[75] Inventors: Richard Norman; Sonja Norman, both of Sutton; David Chamberlain, Knowlton, all of Canada

[73] Assignee: Profitable Entertainment Products, Inc., Knowlton, Canada

[21] Appl. No.: 421,363

[22] Filed: Oct. 16, 1989

Related U.S. Application Data

[63] Continuation of Ser. No. 104,992, Oct. 6, 1987, abandoned.

[51] Int. Cl.[5] ..... A63F 3/00

[52] U.S. Cl. ..... 273/241; 273/287; 273/DIG. 30

[58] Field of Search ..... 273/241, 239, 280, 281, 273/290, 291, 346, 287

[56] References Cited

U.S. PATENT DOCUMENTS

| | | | |
|---|---|---|---|
| 3,359,003 | 12/1967 | Kass | 273/241 |
| 4,456,258 | 6/1984 | Lodrick | 273/241 |
| 4,671,514 | 6/1987 | Wilson-Diehl | 273/DIG. 30 |

OTHER PUBLICATIONS

Frank Brady, *Games,* "The $100,000 Gambit", Jan.-Feb. 1981, pp. 18-20.

*Primary Examiner*—Edward M. Coven
*Assistant Examiner*—William E. Stoll
*Attorney, Agent, or Firm*—Samuel Meerkreebs

[57] ABSTRACT

A tossable, tri-dimensional strategy-type game comprising a tri-dimensional body adapted to be tossed and caught during playing, the body including a playing surface enclosing the body with the playing surface being divided into distinct areas defining a regular pattern of at least first and second visually distinguishable surface areas. A plurality of flexible playing pieces are associated with at least the first surface areas, the playing pieces each having attachments for releasably attaching the playing pieces to selected surface areas with sufficient strength to retain the playing pieces attached to the selected surface areas during tossing while enabling the playing pieces to be manually detached from the selected surface areas. The strategy-type game according to the invention enables players to interact on a common tri-dimensional playing surface without the players being forced to remain in close proximity to one another while the game is in progress.

23 Claims, 6 Drawing Sheets

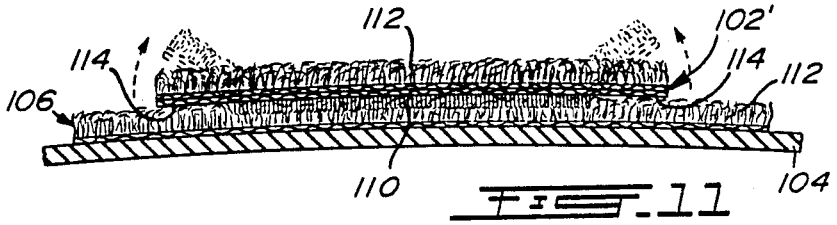
FIG. 11
FIG. 9
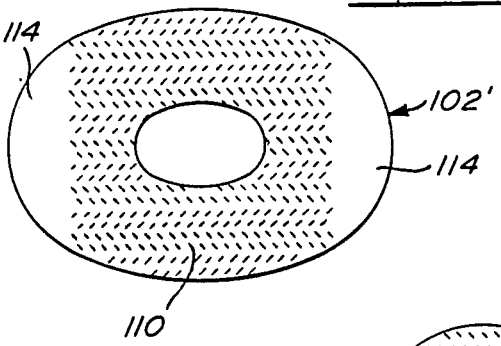
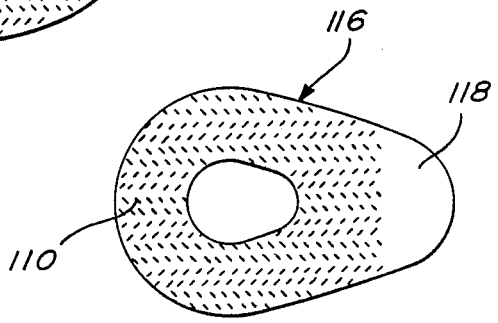
FIG. 10
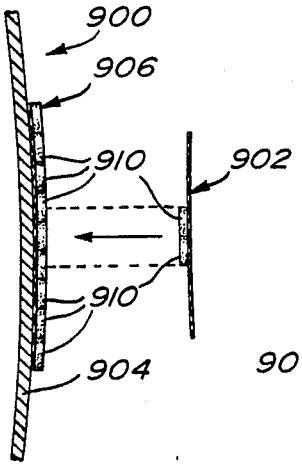
FIG. 12
FIG. 13
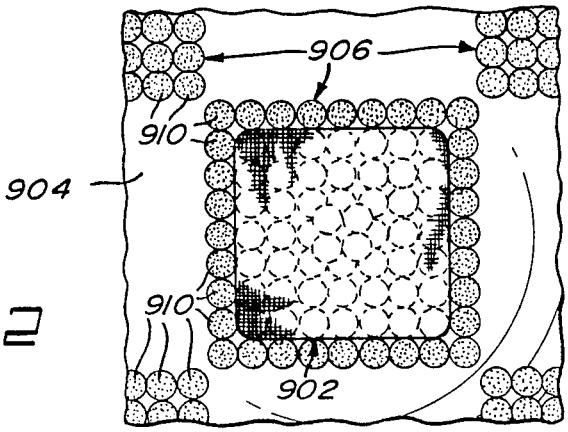

TOSSABLE STRATEGY-TYPE GAME WITH TRI-DIMENSIONAL PLAYING SURFACE

CROSS-REFERENCE TO RELATED APPLICATIONS

This is a continuation application of application Ser. No. 104,992, filed Oct. 6, 1987, now abandoned.

BACKGROUND OF THE INVENTION

1. Field of the Invention

The present invention relates to improvements in strategy-type games. More particularly, the invention is directed to a tossable, tri-dimensional strategy-type game as well as to a tossable, tri-dimensional playing surface for use in playing such a game.

2. Description of the Prior Art

Tri-dimensional strategy-type games are known in the art. U.S. Pat. Nos. 3,359,003, 4,129,303, 4,225,137 and 4,456,258, for instance, disclose examples of tri-dimensional strategy-type game playing surfaces on which releasably attachable playing pieces may be selectively positioned and held in position. Such tri-dimensional playing surfaces are generally divided into a plurality of playing regions or positions adapted to receive playing pieces thereon. However, since these playing surfaces must be mounted or placed on a support while the game is in progress, the enjoyability of games played on them is considerably decreased by having the playing surface fixed in one place during the game, thus forcing the players to remain at or return to that place in order to make their moves or study the playing position. This generally limits the locale of play to a table or some other stable and usually flat surface, and the players usually remain seated throughout most of the game. In other words, the players not only have to remain in close proximity to one another during the course of play but also to occupy set positions in relation to the playing surface. The overall result is that the players must adapt to the locale of the game rather than the game adapting to the players. Moving the game to the players instead of the players to the game risks dislodging playing pieces or even causing injury to a player, particularly if the playing surface with attached playing pieces is heavy or has projections or sharp corners or edges.

Releasably attachable playing pieces are essential to most games played on tri-dimensional playing surfaces. These playing pieces are generally rigid, relatively heavy and project from the playing surface. The more rigid a piece and the farther it projects from the playing surface the more likely it is to become snagged and detached during movement of the game. Also, the heavier and more projecting the playing pieces and the heavier the combined playing surface and attached pieces, the more likely the pieces are to detach through sudden accelerations or decelerations, such as in throwing, catching or dropping the game. Heavy and/or sharp playing pieces and/or playing surfaces further contribute to the possibility of player injury.

SUMMARY OF THE INVENTION

It is therefore an object of the present invention to overcome the above drawbacks and to provide a tossable, tri-dimensional strategy-type game enabling players to interact on a common tri-dimensional playing surface without the players being forced to remain in close proximity to one another while the game is in progress.

In accordance with one aspect of the invention, there is thus provided a tossable, tri-dimensional strategy-type game comprising a tri-dimensional body adapted to be tossed and caught during play, the body including a playing surface enclosing the body with the playing surface being divided into distinct areas defining a regular pattern of at least first and second visually distinguishable surface areas. A plurality of flexible playing pieces are associated with at least the first surface areas, the playing pieces each having attachment means for being releasably attached to selected surface areas with sufficient strength to be retained on the selected surface areas during tossing while enabling the playing pieces to be manually detached from the selected surface areas.

The present invention also provides, in another aspect thereof, a tossable, tri-dimensional strategy-type game playing surface which encloses a tri-dimensional body adapted to be tossed and caught during play, the playing surface being divided into distinct areas defining a regular pattern of at least first and second visually distinguishable surface areas such that the first surface areas each have a constant predetermined number of playing paths to adjacent first surface areas.

By the expression "visually distinguishable surface areas" as used herein is meant areas which are readily discernable as different to the unaided eye whether through color, texture, shape, dimension, contour or elevation above or depression below the surrounding surfaces, or through merely being outlined.

The expression "playing path", on the other hand, can be defined as visually discernable interconnections between playing regions, whether the regions are in actual contact or connected with one another, or are spaced from one another by a distance still maintaining an obvious relationship between adjacent playing regions.

The expression "endless playing surface" means a playing surface on a three-dimensional article which is not interrupted by any physical obstacles or defined boundaries. The play can occur in virtually any direction, depending on the rules. The pattern can vary, and the number of playing paths can change, but the playing surface is generally unimpeded in any orientation.

While the allowable movement of pieces in a game is ultimately defined by the rules for that game, for reasons of practicality and playability these rules are best dependant on recognizable features of the playing surface. Considering, for example, an ordinary red and black checkerboard on which many games can be played, these games all make use of the clearly defined pattern on the board. Playing paths are defined in relation to this pattern as obvious interconnections between regions. On a checkerboard there are two obvious kinds of playing paths: those across the corners of the squares and those across the sides. Different games for this board, such as chess and checkers, use these paths in different ways.

If the squares of the checker pattern were replaced by small circles, the pattern of playing positions would still be apparent and the games could still be played. If each circle were randomly shifted a small distance, the pattern of playing paths would still be apparent. Progressively larger shifts would make the paths less and less discernable until finally chess and checkers could no longer be played on the surface.

The tri-dimensional strategy-type game playing surface according to the invention is characterised by an ideal range of complexity, that is, games can be played on it that are complex enough to repeatedly challenge players and yet not so complex as to be incomprehensible.

Since a game is rendered much more complex when being played on a tri-dimensional playing surface, the provision of first surface areas or playing regions each having a constant predetermined number of playing paths to adjacent first surface areas reduces the complexity of the game to an enjoyable yet challenging level. Preferably, such a predetermined number of playing paths is at least three.

Although it is a feature of the invention to provide a tossable, tri-dimensional strategy-type game playing surface enabling players to sit wherever they choose or to move about, bounded only by the distance that the game can be tossed, such a playing surface need not necessarily be tossed to render the game enjoyable. The playing surface, for example, if enclosing a spherical or toroidal body, can be rolled on a flat surface between players rather than being tossed.

Accordingly, the present invention provides in a further aspect thereof a tri-dimensional strategy-type game playing surface enclosing a tri-dimensional body and being divided into distinct areas defining a regular pattern of at least first and second visually distinguishable surface areas such that the first surface areas each have a constant predetermined number of playing paths to adjacent first surface areas.

In a preferred embodiment of the strategy-type game according to the invention, the playing pieces each have first attachment means cooperable with second attachment means on at least the first surface areas for releasably attaching the playing pieces to selected surface areas, the first and second attachment means being such as to enable the playing pieces to be peeled off the selected surface areas. Preferably, the first and second attachment means comprise pile fasteners. The first and second attachment means can also comprise a plurality of closely spaced first and second attachment elements provided respectively on the playing pieces and on at least the first surface areas, the first and second attachment elements adhering to one another through magnetic force.

As already mentioned, releasably attachable playing pieces are essential to most tri-dimensional playing surfaces. When the playing surface is tossable, the attaching strength of the pieces must be sufficient to withstand not only the force of gravity, but also the rigors of tossing, catching and being dropped. Peeling a flexible piece requires far less force for a given attaching strength than prying or pulling a rigid piece from the same surface since a player only must disengage a fraction of the holding surface at one time. Peelable pieces can therefore have a much higher attaching strength and still be detached by a human hand without applying undue force.

Particularly preferred embodiments are constructed of a spherical or toroidal body that is expanded inside a surface of pile fastener. This construction produces light-weight tri-dimensional playing surfaces of a high degree of uniformity to which pile fastener playing pieces can be releasably attached. Spherical or toroidal bodies also have no potentially sharp edges and corners which could injure players during tossing and catching.

In order to facilitate peeling off of the playing pieces from the surface areas on which they are attached, the playing pieces advantageously each have an attachment portion provided with the first attachment means and a tab portion contiguous to the attachment portion. Oval ring-shaped playing pieces are particularly preferred since they have an extremely good attaching strength to weight ratio and also provide a convenient shape for human fingers to grasp. Oval rings also allow for the inclusion of non-attaching tabs at opposite ends to assist in detaching without unduly reducing the length of the attachment portion. Such a construction produces easily detachable, light weight, low profile playing pieces that remain reliably attached even when the playing surface is tossed, caught, dropped or even bounced from player to player.

According to another preferred embodiment, the playing pieces each have two sides facing opposite directions and are each provided on one side with the first attachment means and on the other side with the second attachment means, that is, the same attachment means as provided on the playing surface, whereby a plurality of playing pieces can be releasably attached one on top of another to provide a flexible stack of playing pieces releasably attached to a selected surface area. This increases the variety of games that can be played on the playing surface. Having playing pieces that can be stacked during play can also be used to solve the problem of storing playing pieces that are not yet in play or that have been removed from play during the game. When relatively thin and light weight playing pieces are used, a stack of a given number of such pieces can be provided which is relatively short and light, thus reducing the detaching force experienced by the playing pieces when the playing surface is tossed, caught or dropped. Stacks that lie close to the playing surface are also advantageous since they reduce the possibility of playing pieces snagging and being dislodged as the game is tossed and caught.

According to a further preferred embodiment, the pattern defined by the surface areas is a checkerboard-like pattern and the playing pieces are associated with only the first surface areas. Preferably, the first surface areas have a polygonal configuration defining a plurality of vertices with each vertex of any given first surface area contacting the vertex of an adjacent first surface area to thereby define the aforementioned playing paths. Polygonal regions joined at their vertices provide a simple way of making playing paths easily discernable.

The tri-dimensional strategy-type game according to the invention, which can be tossed between players, enables the players to move about freely or to occupy comfortable seats and toss the game back and forth while playing. This eliminates the stress of uncomfortable seating and physical immobility that strategy games usually impose upon the players, thus allowing full enjoyment of the game.

BRIEF DESCRIPTION OF THE DRAWINGS

Further features and advantages of the invention will become more readily apparent from the following description of preferred embodiments as illustrated by way of examples in the accompanying drawings, in which:

FIG. 9 is a bottom view of a playing piece for use in a tossable, tri-dimensional strategy-type game according to the invention;

FIG. 10 is a view similar to that of FIG. 9, illustrating a playing piece according to a different embodiment;

FIG. 11 is a fragmentary sectional view of a tossable, tri-dimensional strategy-type game playing surface with a playing piece thereon, showing how the playing piece can be peeled off;

FIG. 12 is another fragmentary sectional view illustrating how a magnetic-type playing piece can be releasably attached to a tossable, tri-dimensional strategy-type game playing surface according to the invention; and FIG. 13 is a fragmentary front view illustrating the embodiment represented in FIG. 12.

DESCRIPTION OF PREFERRED EMBODIMENTS

Figure 1:
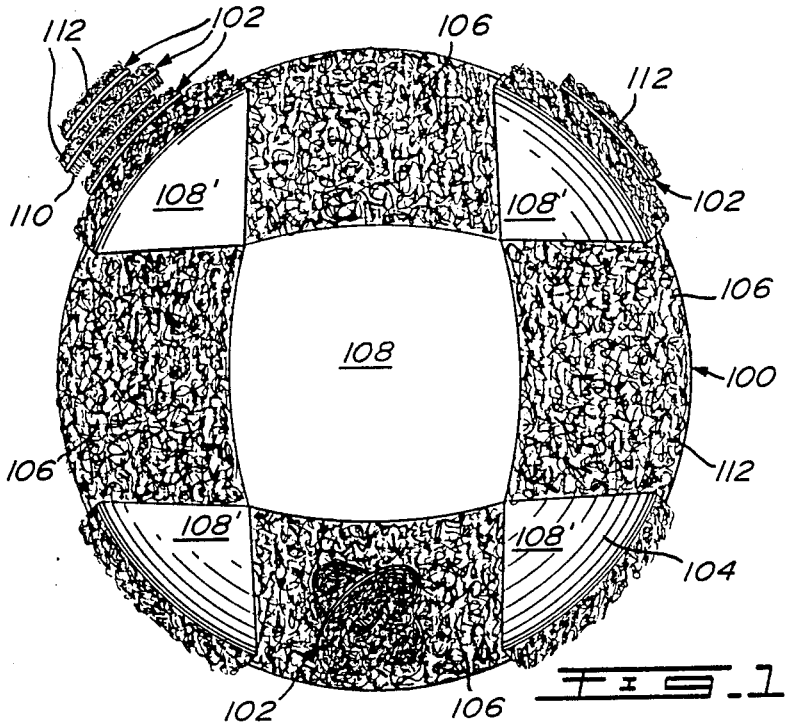
FIG. 1 is a first view, of a tossable, tri-dimensional strategy-type game playing surface with playing pieces thereon, according to a first preferred embodiment of the invention.

Referring first to FIG. 1, there is shown a tossable, tri-dimensional strategy-type game comprising a tri-dimensional playing surface 100 of spherical configuration and a plurality of flexible, oval ring-shaped playing pieces 102 selectively positionable thereon. The playing surface 100 encloses a spherical body 104 made of resilient material, such as an inflated plastic ball, and is divided into a plurality of square surface areas 106 defining playing regions adapted to receive playing pieces 102 thereon, the surface areas 108,108' defined between the square playing regions 106 constituting non-playing regions, that is, regions on which playing pieces 102 are not positioned. As shown, each square playing region 106 has two neighboring square non-playing regions 108 (only one shown) and two neighboring triangular non-playing regions 108', the playing and non-playing regions 106 and 108,108' defining a checkerboard pattern.

Each corner of any given square playing region 106 contacts the corner of an adjacent square playing region 106 to thereby define a playing path between such regions. Since each playing region 106 has four adjacent playing regions, the number of playing paths from any given playing region to adjacent playing regions is thus equal to the number of adjacent playing regions.

The playing pieces 102 are each provided with hook fasteners 110 engageable with loop fasteners 112 provided on each playing region 106 so as to be releasably retained on selected playing regions 106 when positioned thereon. In order to increase the variety of games that can be played on the surface 100, each playing piece 102 is further provided on its top with loop fasteners 112 such as to enable a plurality of playing pieces 102 to be releasably attached one on top of another to provide a flexible stack of playing pieces releasably attached to a selected playing region 106. The hook and loop fasteners 110,112 which are utilized as cooperable attachment means are available under the trade mark VELCRO.

Figure 2:
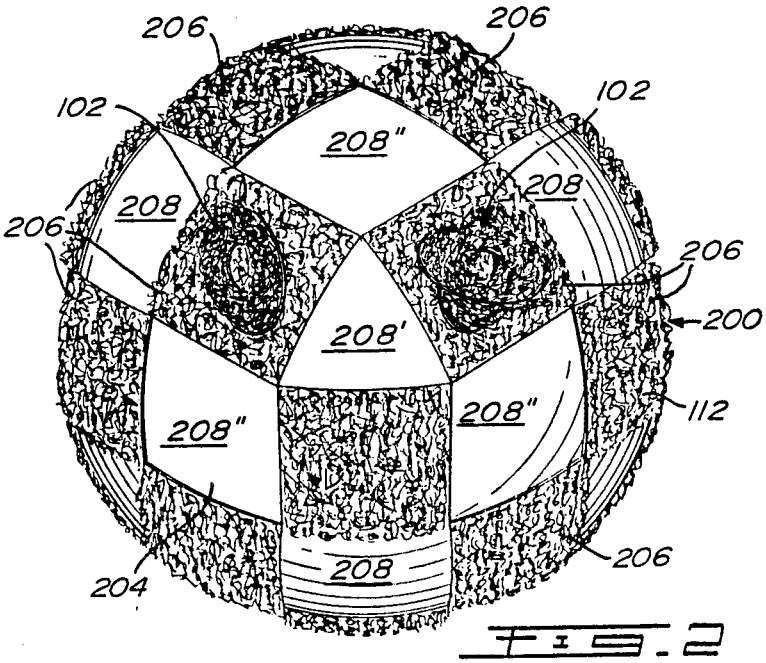
FIG. 2 is a view similar to that of FIG. 1, illustrating a second preferred embodiment according to the invention.

In the embodiment illustrated in FIG. 2, the playing surface 200 which also encloses a spherical body 204 has twenty-four square playing regions 206 provided with loop fasteners 112, instead of twelve as in FIG. 1. As shown, each square playing region 206 has one neighboring square non-playing region 208, one neighboring triangular non-playing region 208' and two neighboring rhombic or diamond-shaped non-playing regions 208''. The playing regions 206 also each have a number of adjacent playing regions which is the same as the number of playing paths thereto, namely four.

Figure 3:
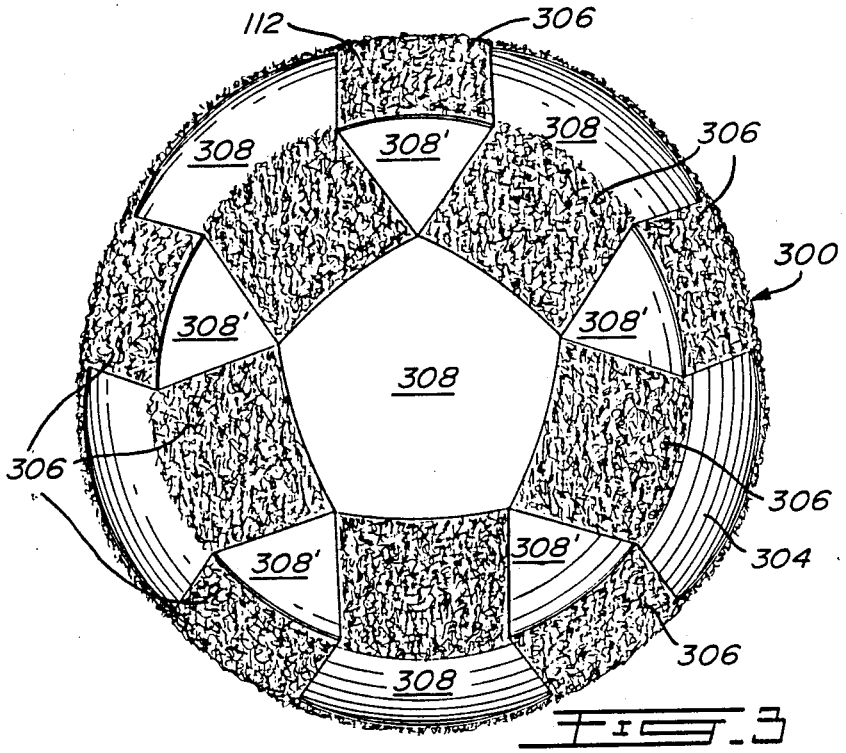
FIG. 3 is another front view illustrating a tossable, tri-dimensional strategy-type game playing surface according to a third preferred embodiment of the invention.

The tri-dimensional playing surface 300 illustrated in FIG. 3 also encloses a spherical body 304, but comprises thirty square playing regions 306 provided with loop fasteners 112. Each square playing region 306 has two neighboring pentagonal non-playing regions 308 and two neighboring triangular non-playing regions 308'. As in the embodiments of FIG. 1 and 2, each playing region 306 has the same number of adjacent playing regions as the number of playing paths thereto, namely four.

Figure 4:
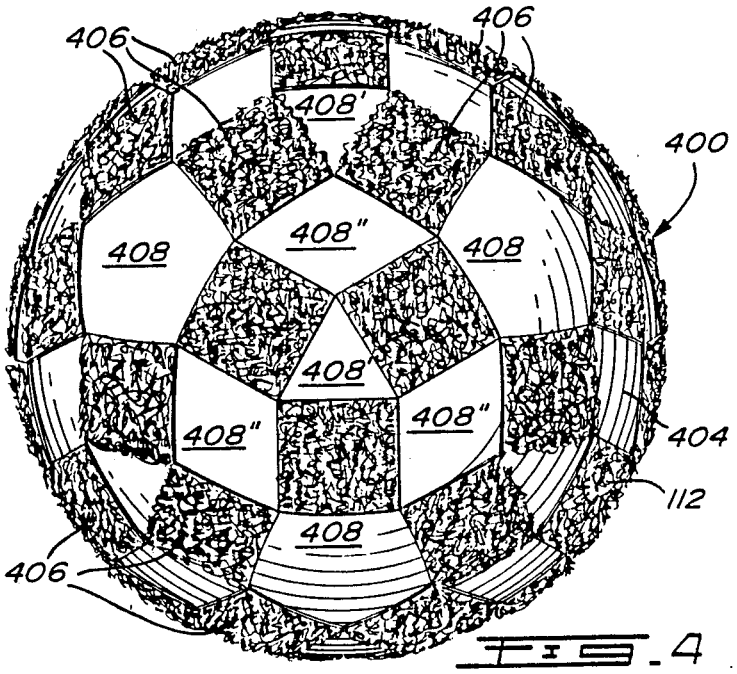
FIG. 4 is a view similar to that of FIG. 3, illustrating a fourth preferred embodiment according to the invention.

The tri-dimensional playing surface 400 illustrated in FIG. 4, which encloses a spherical body 404, comprises sixty square playing regions 406 provided with loop fasteners 112. As shown, each square playing region 406 has one neighboring pentagonal non-playing region 408, one neighboring triangular non-playing region 408' and two neighboring rhombic non-playing regions 408''. Each playing region 406 also has the same number of adjacent playing regions as the number of playing paths thereto, namely four.

Figure 5A:
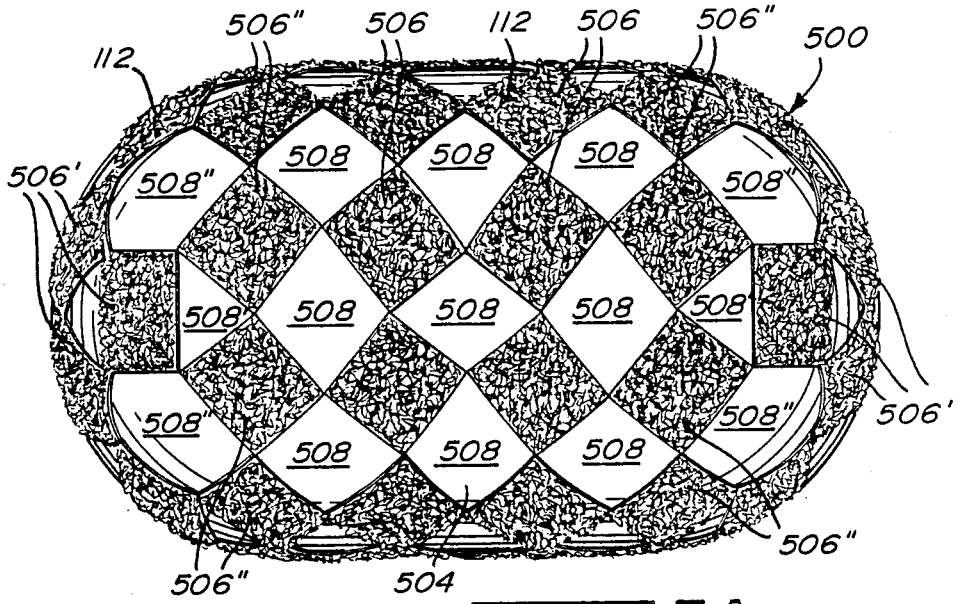
FIG. 5A is a top view illustrating a tossable, tri-dimensional strategy-type game playing surface according a fifth preferred embodiment of the invention.
Figure 5B:
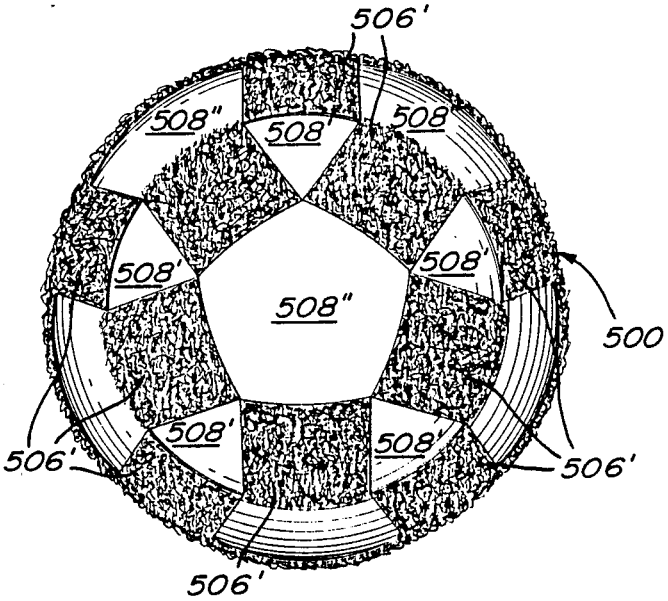
FIG. 5B is an end view of the playing surface illustrated in FIG. 5A.

Turning to the embodiment illustrated in FIGS. 5A and 5B, there is shown a tri-dimensional playing surface 500 of oblong configuration enclosing an oblong body 504 and comprising sixty square playing regions 506,506',506'' provided with loop fasteners 112. The square playing regions 506 in the central portion of the playing surface 500 each have four neighboring rhombic non-playing regions 508 whereas the square playing regions 506' at the end portions each have two neighboring triangular non-playing regions 508' and two neighboring pentagonal non-playing regions 508''. On the other hand, the square playing regions 506'' in the transition portions each have two neighboring rhombic non-playing regions 508, one neighboring triangular non-playing region 508' and one neighboring pentagonal non-playing region 508''. The playing regions 506,506' and 506'' also each have the same number of adjacent playing regions as the number of playing paths thereto, i.e. four.

Figure 6A:
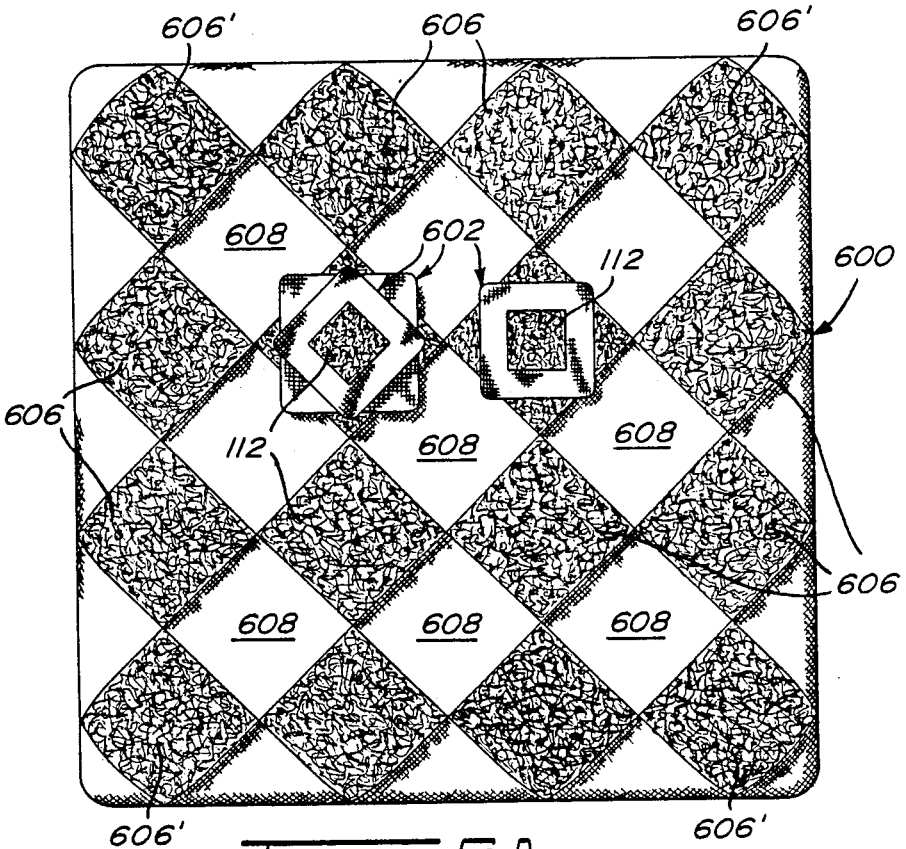
FIG. 6A is another top view illustrating a tossable, tri-dimensional strategy-type game playing surface with playing pieces thereon, according to a sixth preferred embodiment of the invention.
Figure 6B:
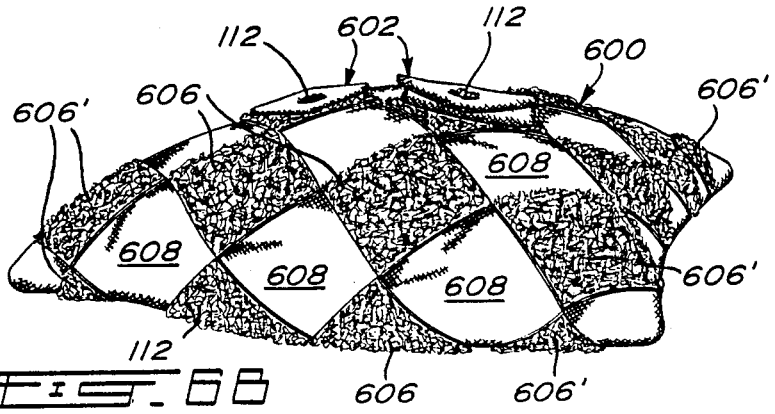
FIG. 6B is a perspective view of the strategy-type game illustrated in FIG. 6A.

In the embodiment illustrated in FIGS. 6A and 6B, the tri-dimensional playing surface 600 is in the form of a pillow and comprises thirty-two square playing regions 606,606' provided with loop fasteners 112. Square pieces of fabric material are used as playing pieces 602. The playing pieces 602 are each provided on their bottom, in a central portion, with hook fasteners (not shown) engageable with the loop fasteners 112 on the playing regions 606. Each playing piece 602 is also provided on its top, in a central portion, with loop fasteners 112 so as to enable a plurality of playing pieces 602 to be stacked one on top of another while being releasably attached to one another. As shown, each square playing region 606 has four neighboring square non-playing regions 608, except at the corners of the playing surface. Each playing region 606 also has four adjacent playing regions and the same number of playing paths thereto. On the other hand, the playing regions 606' at the corners of the playing surface each have three adjacent playing regions, namely two playing regions 606 and one playing region 606', but has four playing paths to those regions, i.e., one playing path to each playing region 606 and two separate playing paths to the playing region 606'.

Figure 7:
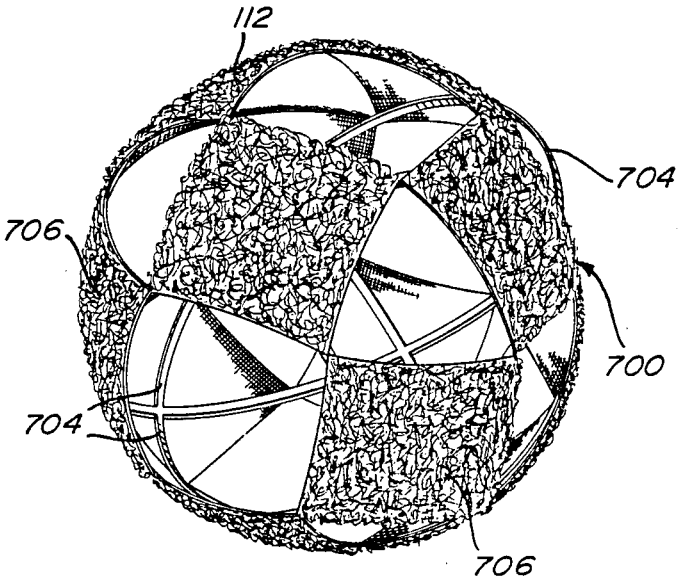
FIG. 7 is a perspective view of a tossable, tri-dimensional strategy-type game playing surface according to a seventh preferred embodiment of the invention.

The embodiment illustrated in FIG. 7 is essentially the same as that shown in FIG. 1, in that the tri-dimensional playing surface 700 has a spherical configuration and comprises twelve playing regions 706 provided with loop fasteners 112. However, instead of having a spherical supporting body as in FIG. 1, a plurality of supporting circular ribs 704 are provided. In this case, the non-playing regions defined between the playing regions 706 are thus voids.

Figure 8:
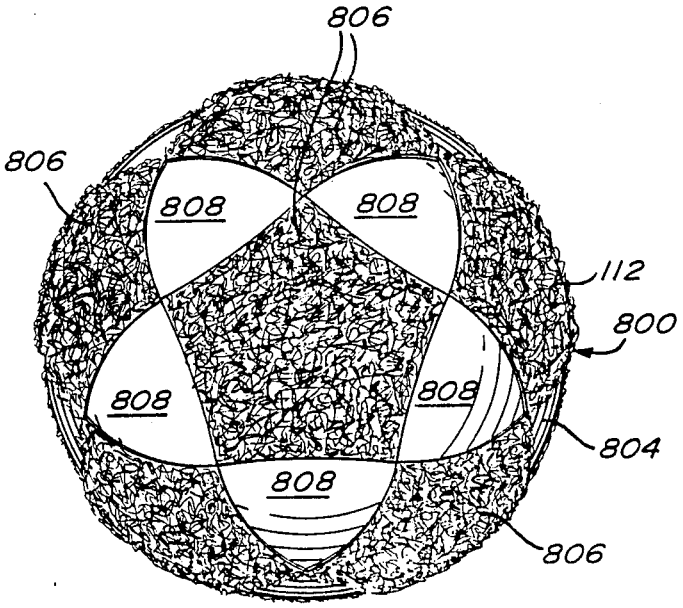
FIG. 8 is a front view of a tossable, tri-dimensional strategy-type game playing surface according to a eight preferred embodiment of the invention.

The tri-dimensional playing surface 800 illustrated in FIG. 8, which encloses a spherical body 804, comprises twelve pentagonal playing regions 806 provided with loop fasteners 112. Each pentagonal playing region 806 has five neighboring triangular non-playing regions 808. Each playing region 806 also has five adjacent playing regions and the same number of playing paths thereto.

FIGS. 9 and 10 illustrate modified forms of playing pieces. In FIG. 9, the oval ring-shaped playing piece 102' is similar to the playing piece 102 illustrated in FIGS. 1 and 2, in that it comprises back-to-back hook and loop fasteners 110,112. However, it has been modified by the provision at opposite ends of two tab portions 114 which are free of hook fasteners 110 to facilitate peeling off. The playing piece 116 illustrated in FIG. 10 which has an egg shape also comprises back-to-back hook and loop fasteners and a tab portion 118 which is free of hook fasteners 110. As shown in FIG. 11, the playing piece 102' can be easily peeled off the playing region 106 provided with loop fasteners 112 by grasping with one's fingers either tab portion 114 of the playing piece 102' and pulling in a direction away from the playing surface.

It is also possible to use magnetic-type playing pieces as illustrated in FIGS. 12 and 13. As shown, the tri-dimensional playing surface 900 which encloses a spherical body 904 comprises a plurality of spaced-apart square playing regions 906 each defined by a plurality of small magnetic disks 910 adhered to the body 904 and arranged in close spaced relationship to one another. The playing piece 902 which is made of fabric material is also provided in a central portion thereof with a plurality of similar magnetic disks 910. Thus, the playing piece 902 can be releasably attached to the playing region 906 by means of the disks 910 adhering to one another through magnetic force.

Even though the playing pieces 102,102', 116, 602 and 902 are attached firmly enough to withstand the rigors of tossing and catching, their flexibility allow them to be easily peeled off by the players.

We claim:

1. A tossable, lightweight, tri-dimensional game comprising:

a tri-dimensional body to be tossed and caught during play, said body including an endless playing surface; said endless playing surface including distinct areas defining at least first and second visually distinguishable surface areas forming an uninterrupted alternating pattern; and a plurality of playing pieces, said playing pieces each having attachment means for being releasably attached to at least said first surface areas with sufficient strength to be retained on said selected surface areas during tossing while enabling said playing pieces to be manually detached from said selected surface areas.

2. A strategy-type game as claimed in claim 1, wherein said body has a substantially spherical configuration.

3. A strategy-type game as claimed in claim 1, wherein said playing pieces are flexible and each have first attachment means cooperable with second attachment means on at least said first surface areas for releasably attaching said playing pieces to selected surface areas, and wherein said first and second attachment means and playing piece flexability are such as to enable said playing pieces to be peeled off said selected surface areas.

4. A strategy-type game as claimed in claim 3, wherein said first and second attachment means comprise a plurality of first and second magnetic members adhered respectively to said playing pieces and to at least said first surface areas.

5. A strategy-type game as claimed in claim 3, wherein said playing pieces each have two sides facing opposite directions and are each provided on one side with said first attachment means and on the other side with said second attachment means, whereby a plurality of playing pieces can be releasably attached one on top of another to provide a stack of playing pieces releasably attached to a selected surface area.

6. A strategy-type game as claimed in claim 1, wherein said said playing pieces are attachable to only said first surface areas.

7. A strategy-type game as claimed in claim 1, wherein said first surface areas each have an equal number of playing paths to adjacent first surface areas.

8. A strategy-type game as defined in claim 7, wherein said first surface areas have a polygonal outline defining a plurality of vertices with each vertex of any given first surface area contacting the vertex of an adjacent first surface area to thereby define said playing paths.

9. A tri-dimensional strategy-type game, comprising an endless playing surface, said endless playing surface enclosing a tri-dimensional body with said endless playing surface being divided into distinct areas defining at least first and second visually distinguishable surface areas forming a pattern such that said first surface areas each have an equal number of playing paths to adjacent first surface areas.

10. A tri-dimensional strategy-type game as defined in claim 9, with said endless playing surface being divided into distinct areas defining at least first and second visually distinguishable surface areas forming an uninterrupted alternating pattern.

11. A strategy-type game playing surface as claimed in claim 9, wherein said body has a substantially spherical configuration.

12. A strategy-type game playing surface as claimed in claim 9, wherein said predetermined number of playing paths is at least three.

13. A strategy-type game playing surface as claimed in claim 12, wherein said predetermined number of playing paths is equal to four.

14. A strategy-type game playing surface as claimed in claim 9, wherein said first surface areas have a polygonal outline defining a plurality of vertices with each vertex of any given first surface area contacting the vertex of an adjacent first surface area to thereby define said playing paths.

15. A strategy-type game playing surface as claimed in claim 14, wherein said first surface areas have a triangular outline.

16. A strategy-type game playing surface as claimed in claim 14, wherein said first surface areas have a square outline 17. A strategy-type game playing surface as claimed in claim 14, wherein said first surface areas have a pentagonal outline.

18. A strategy-type game playing surface as claimed in claim 9, wherein said first surface areas each have an equal number of adjacent first surface areas and wherein said equal number of playing paths is equal to said equal number of adjacent first surface areas.

19. A strategy-type game playing surface as claimed in claim 9, wherein at least two of said first surface areas have fewer adjacent first surface areas than playing paths to said adjacent first surface areas.

20. A strategy-type game playing surface as claimed in claim 12, 14, or 17, wherein said first surface areas are identical in configuration relative to one another.

21. A tri-dimensional strategy-type game comprising:

a tri-dimensional body including an endless playing surface; said endless playing surface including distinct areas defining at least first and second visually distinguishable surface areas forming an uninterrupted alternating pattern; and a plurality of playing pieces, said playing pieces each having attachment means for being releasably attached to at least said first surface areas with sufficient strength to be retained on said selected surface areas while enabling said playing pieces to be manually detached from said selected surface areas.

22. A strategy-type game playing surface as claimed in claim 10, 11, 12, 14, or 17, wherein said first surface areas are at least twelve in number.

23. A strategy-type game playing surface as claimed in claim 12, 14, or 17, wherein said first surface areas are identical in configuration relative to one another, and wherein said first surface areas are at least twelve in number.

* * * * *